US005139579A

United States Patent [19]

Kovacs et al.

[11] Patent Number: 5,139,579

[45] Date of Patent: Aug. 18, 1992

[54] METHOD FOR PREPARING HIGH SILICON, LOW CARBON AUSTEMPERED CAST IRON

[75] Inventors: Bela V. Kovacs, Bloomfield Hills; John R. Keough; Douglas M. Pramstaller, both of Livonia, all of Mich.

[73] Assignee: Applied Process, Livonia, Mich.

[21] Appl. No.: 737,196

[22] Filed: Jul. 29, 1991

Related U.S. Application Data

[62] Division of Ser. No. 515,243, Apr. 27, 1990, Pat. No. 5,043,028.

[51] Int. Cl.[5] ..... C21D 5/00

[52] U.S. Cl. ..... 148/545; 148/322

[58] Field of Search ..... 148/3, 15, 18, 141, 148/322

[56] References Cited

U.S. PATENT DOCUMENTS 2,796,373 6/1957 Berg ..... 148/141

FOREIGN PATENT DOCUMENTS 229877 11/1985 German Democratic Rep. .

OTHER PUBLICATIONS

*Metals Handbook,* 9th Ed, vol. 4; 1981 pp. 104–105; 299–302.

John Keough; *Industrial Heating;* "Process and Equipment Development in Austempering Ductile Iron Increase its Utility" pp. 56–59; Sep. 1989.

J. F. Janowak and R. B. Gundlach; *Journal of Heat Treating;* vol. 4 No. 1 "Approaching Austempered Ductile Iron Properties by Controlled Cooling in the Foundry" Jun. 1985, pp. 25–31.

*Primary Examiner*—R. Dean
*Assistant Examiner*—Margery S. Phipps
*Attorney, Agent, or Firm*—Lynn E. Cargill

[57] ABSTRACT

A method for preparing an austempered cast iron which includes an ausferritic matrix, the cast iron having a silicon content of from about 1.6 to about 2.4 weight percent, and a carbon content of from about 1.6 to about 2.2 weight percent, such that the carbon equivalent of the cast iron is from about 2.1 to about 3.0 weight percent. The method includes (a) melting the cast iron composition; (b) pouring the melt into a mold to form a casting having eutectic carbide particles; (c) altering the temperature of the casting to about 1650°–1900° F. and maintaining the temperature of the casting at about 1650°–1900° F. until substantially all of the eutectic carbide particles convert to temper graphite nodules to form a temper graphite-containing casting; (d) cooling the temper graphite-containing casting to about 1500°–1750° F. and maintaining the temperature of the tempered graphite-containing casting at about 1500°–1750° F. until a fully austenitic matrix is achieved; (e) quenching the austenitic matrix casting to a temperature of between about 460° to about 750° F. and maintaining that temperature until the entire casting is transformed to an ausferritic matrix; and (f) cooling the ausferritic matrix casting to room temperature before bainite is formed.

5 Claims, 3 Drawing Sheets

METHOD FOR PREPARING HIGH SILICON, LOW CARBON AUSTEMPERED CAST IRON

CROSS REFERENCE TO RELATED APPLICATION

This application is a divisional of Ser. No. 07/515,243 filed Apr. 27, 1990, now U.S. Pat. No. 5,043,028 which is hereby incorporated by reference.

TECHNICAL FIELD

This invention relates generally methods of making cast irons, and more particularly, relates to a method for preparing austempered cast iron compositions having a high silicon and a low carbon content.

BACKGROUND OF THE INVENTION

There are generally two types of cast irons which can be plastically deformed, those being malleable and ductile iron. Malleable cast irons are capable of being extended in all directions by hammering or rolling and typically contain about 0.8 to about 1.2 weight percent silicon and about 2.3 to about 2.8 weight percent carbon. Ductile cast irons are capable of being lengthened or flattened out, without losing continuity, when subjected to tensile stresses or rolling and typically contain about 2.2 to 3 weight percent silicon and about 3.4 to 3.8 weight percent carbon.

With either type of cast iron, most prior art practice has indicated that having carbon in predominantly graphite form is more desirable than having it in carbidic form. In typical graphite-containing cast irons, graphite precipitates and forms nodules upon cooling. When the alloy is further cooled to freezing, austenite forms around the graphite particles. The first austenite formed surrounding the graphite nodules will have a relatively high amount of silicon and will reject manganese.

Therefore, the manganese accumulates at the cell boundaries of the matrix and creates a non-uniform material with non-uniform physical properties. It has been known that elemental manganese may become as much as 10 times more concentrated at the cell boundaries than elsewhere in the matrix in typical graphite-containing cast irons. A non-uniform material with these high local concentrations of manganese are inherently weak in those areas after heat treatment, which may ultimately be the cause of premature failure due to breaking. In addition, graphites generally do not contribute to the strength of a cast iron, because they form a weak link to the cast iron matrix. Therefore, in prior art practice, the resulting cast iron products were not optimum in strength due to the higher volumes of graphite.

Examples of prior art cast irons and methods for making them are described in the following patents:

U.S. Pat. No. 2,749,238 to Millis, et al. discloses a method for producing a cast ferrous alloy containing at least about 50% iron, particularly at least about 87% iron, and carbon and silicon within the cast iron range, the carbon being in excess of that required to form the matrix being predominantly in the uncombined form, and containing a small but effective amount of magnesium to control the form of the uncombined carbon. The patent discloses that typical ferrous baths generally will contain over 1.7% percent carbon and may contain as much as 5% carbon and at least about 0.5% silicon and may contain as much as 6% silicon.

U.S. Pat. No. 3,728,107 to Loricchio discloses the addition of silicon carbide pelleted with chromite to molten iron for homogenizing the microstructure to control the hardness. The patent also discloses that, in general, the invention relates to cast iron which is understood to include any carbon iron alloy containing more than 1.7% total carbon and, more particularly, up to about 4% carbon. Such alloys may contain from 0.5 to 3.0% silicon and from 0.5 to 1.0% manganese.

U.S. Pat. No. 3,998,664 to Rote discloses a heat treated cast iron wherein the carbon and silicon contents are controlled to produce a white iron as cast in a sand mold and the sulfur content is in excess of that required to combine with all the manganese in the iron. The iron is annealed to produce temper carbon and a ferrous matrix containing a uniform distribution of iron sulfide particles of finite size.

U.S. Pat. No. 4,072,511 to Coyle discloses a method for producing cast iron including the steps of providing an initial cupola charge having a silicon content less than the silicon content required, melting the charge, conducting the melt to a mixing vessel, substantially increasing the silicon content of the melt by adding granular silicon carbide to the mixing vessel while simultaneously agitating the melt to achieve a good mix and conducting the silicon-enriched melt to a holding vessel or a molding line.

U.S. Pat. No. 4,096,002 to Ikawa, et al. discloses high duty ductile cast iron with super plasticity containing some carbide stabilizing elements, such as, manganese or molybdenum, to have the maximum strength rate sensitivity factor of more than 0.3 and having a very refined grain matrix structure.

U.S. Pat. No. 4,222,793 to Grindahl discloses a method for making high stress nodular iron gears which includes: casting nodular iron blank; heating blank to ferritize its microstructure prior to cutting teeth into the blank; heating it in a non-oxidizing environment to an austenitic phase dissolved-carbon-content of about 0.7% to about 1.1%; rapidly quenching the austentized casting to an acicular-bainite-forming isothermal transformation temperature; isothermally transforming the austenite at that temperature to at least 50% acicular-bainite before cooling; and shot peening at least the roots of the teeth to impart the residual compressive stresses thereto.

U.S. Pat. No. 4,396,442 to Nakamura, et al. discloses a ductile cast iron roll which comprises 3.0 to 3.8% C, 1.5 to 2.5% Si, 0.2 to 1.0% Mn, 0.01 to 0.2% P, less than 0.06% S, 0.7 to 3.0% Ni, 0.1 to 0.6% Cr, 0.1 to 0.8% Mo, 0.02 to 0.1% Mg, balance iron and unavoidable impurities and the base structure having a fine two-phase structure of ferrite mingled with pearlite.

U.S. Pat. No. 4,435,226 to Neuhauser, et al. discloses a wear resistant cast iron alloy having a tempered structure with spheroidal graphite separation comprised of 1.5 to 3.0% carbon, 3.0 to 6.0% silicon, 0.1 to 2.0% manganese, along with other elements.

U.S. Pat. No. 4,475,956 to Kovacs, et al. discloses a method of making high strength ferritic ductile iron parts in which the iron alloy melt consists essentially of by weight 3.9 to 6.0% silicon, 3.0 to 3.5% carbon, 0.1 to 0.3% manganese, 0 to 0.35% molybdenum, at least 1.25% nickel, no greater than 0.015% sulfur and 0.6% phosphorus, the remainder iron, the melt having been subjected to a nodular agent to form graphite nodules upon solidification.

U.S. Pat. No. 4,484,953 to Kovacs, et al. discloses a method of making ductile cast iron with improved strength having a matrix of acicular ferrite and bainite. The cast iron melt by weight consists of 3.0 to 3.6% carbon, 3.5 to 5% silicon, 0.7 to 5% nickel, 0 to 0.3% molybdenum, greater than 0.015% sulfur, greater than 0.06% phosphorus, and the remainder being iron, the melt being subjected to a nodularizing agent and solidified.

U.S. Pat. No. 4,596,606 to Kovacs, et al. discloses a method of making compacted graphite cast iron wherein a ferrous alloy is melted consisting essentially of, by weight, 3 to 4% carbon, 2 to 3% silicon, 0.2 to 0.7% manganese, 0.25 to 0.4% molybdenum, 0.5 to 3.0% nickel, up to 0.002% sulfur, up to 0.02% phosphorus and impurities or contaminants up to 1.0%, with the remainder being essentially iron. The melt is subjected to a graphite modifying agent to form compacted graphite upon solidification.

U.S. Pat. No. 4,619,713 to Fuenaga discloses a method for producing nodular graphite cast iron comprising pouring a melt having a nodular graphite cast iron composition into a mold; solidifying the melt in the mold to form a casting; removing the casting from the mold at a predetermined temperature above the $A_1$ transformation temperature; rapidly cooling the casting at a cooling rate sufficient to prevent the generation of pearlite; stopping the rapid cooling at a temperature above the $M_s$; substantially isothermally transforming the casting to form a matrix structure consisting essentially of bainite; and cooling the casting to normal temperature.

U.S. Pat. No. 4,666,533 to Kovacs, et al. discloses a hardenable cast iron and the method of making the cast iron, wherein the cast iron melt has by weight percent a carbon equivalent equal to 4.3 to 5.0 percent, 0.55 to 1.2% manganese, 0.5 to 3.0% nickel, and the remainder being essentially iron.

U.S. Pat. No. 4,737,199 to Kovacs discloses a machinable ductile or semiductile cast iron and method for making the same which begins by forming a ferrous alloy melt consisting essentially by weight, of 3 to 4% carbon, 2.0 to 3.0% silicon, 0.1 to 0.9% manganese, up to 0.02% phosphorus, up to 0.002% sulfur, up to 1% contaminants or impurities, 0 to 0.4% molybdenum, 0 to 3.0% nickel or copper, and the remainder being substantially iron.

In addition to the patents describing cast iron compositions, U.S. Pat. No. 3,951,697 to Sherby, et al. discloses a method for treating ultra high carbon steel including heat treatment and mechanical working under sufficient deformation to refine the iron grade and spheroidize the cementite. An alternative method is disclosed which includes mixing and sintering fine cementite containing-iron alloy powders and iron powders.

All of the above-mentioned prior art attempts to prepare a cast iron having the desired properties have met with limited success. Uniformity of the physical characteristics throughout the bulk of the material has not been achieved to the degree which is desirable.

Therefore, it is a primary object of the present invention to prepare a cast iron having uniform structure and physical properties and improved mechanical properties, such as, thermal and stress stability with little or no transformation to martensite, good elongation, and good ductility, resulting in a strong, steel-like highly machinable material.

It is another object of the present invention to provide a method for preparing a strong cast iron with uniform solute distribution (i.e., manganese being evenly distributed in the matrix) for uniform reaction during heat treatment and for uniform properties.

Furthermore, it is an object of the present invention to prepare a cast iron with lower than typical graphite levels. It is yet another object of the invention to prepare a cast iron with a wide margin for heat treatment operations and with an easy control of the matrix structure.

SUMMARY OF THE INVENTION

In accordance with the preferred embodiment of the invention, these and other objects and advantages are addressed as follows. A method for preparing an austempered cast iron is disclosed which includes an ausferritic matrix, the cast iron having a silicon content of from about 1.6 to about 2.4 weight percent, and a carbon content of from about 1.6 to about 2.2 weight percent, such that the carbon equivalent of the cast iron is from about 2.1 to about 3.0 weight percent. The resultant ausferritic matrix includes a combination of acicular ferrite and stable austenite supersaturated with carbon.

Generally speaking, the method of the present invention produces an ausferritic matrix which has the typical silicon content of a nodular iron with the typical carbon content of a malleable iron to form a hybrid iron capable of being austempered.

Depending on casting size, it may be necessary to add hardenability agents, such as molybdenum, copper, or nickel, either singly or in any combination thereof, for aiding austemperability. For example, a small casting up to a half inch thickness usually does not require alloying with the above mentioned hardenability agent(s) because the part is so small that sufficient quenching severity can be experienced throughout the bulk of the casting without the hardenability agents. On the other hand, heavier castings require the addition of such hardenability agents to allow through quenching of the thicker casting components to achieve through hardening of the desired severity. Ranges of the hardenability agents change with the size of the casting, but ranges of molybdenum 0 to 0.5% by wt., copper 0 to 0.8% by wt., and nickel 0 to 2.0% by wt. have been found to be particularly effective for larger castings than those having thicknesses greater than one-half inch. The amounts of these elements to be incorporated are greatly dependent upon the quenching equipment and the quenching mediums being used.

Preparing austempered cast iron in accordance with the present invention includes (a) melting the special cast iron mixture to form a melt; (b) pouring the melt into a mold to form a casting having eutectic carbide particles; (c) altering the temperature of the casting to about 1650°-1900° F. and maintaining the temperature of the casting at about 1650°-1900° F. until substantially all of the eutectic carbide particles convert to temper graphite nodules to form a temper graphite-containing casting; (d) cooling the temper graphite-containing casting to about 1500°-1750° F. and maintaining the temperature of the temper graphite-containing casting at about 1500°-1750° F. until a fully austenitic matrix is achieved, and the matrix is saturated with carbon; (e) quenching the austenitic casting to a temperature of about 460° to about 750° F. and maintaining that temperature until substantially the entire casting is transformed to an ausferritic matrix; and (f) cooling the ausferritic matrix casting to room temperature before a substantial amount of bainite is formed. Before the part is altered in temperature to about 1650°-1900° F., the molded part must be shaken out to clean off any residual sand from the molding process.

BRIEF DESCRIPTION OF THE DRAWINGS

The nature and extent of the present invention will be clear from the following detailed description of the particular embodiments thereof, taken in conjunction with the appended drawing, in which.

DETAILED DESCRIPTION OF THE INVENTION

Figure 1:
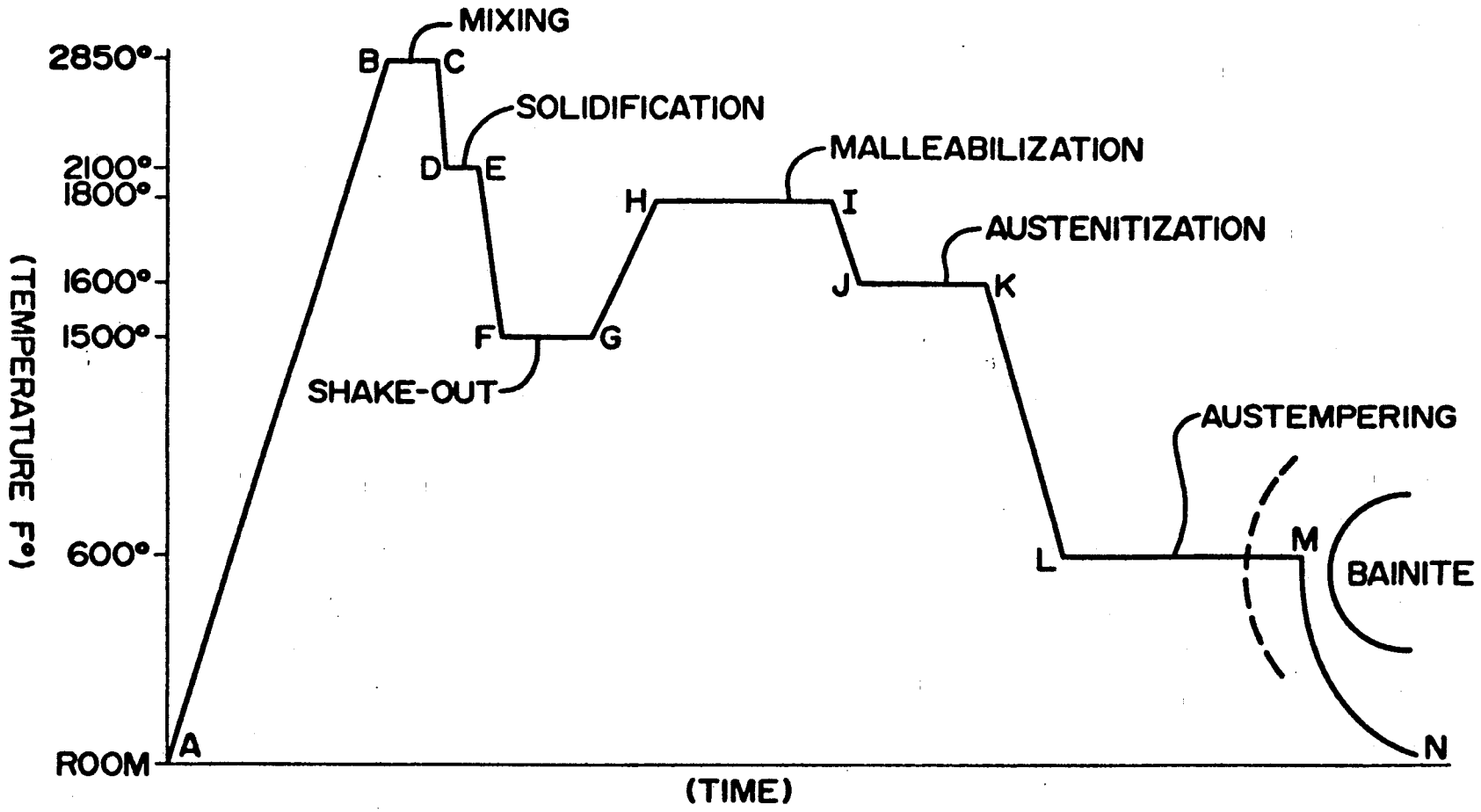
FIG. 1 shows a schematic diagram of the first process for heat-treating the cast iron composition of the invention.

A method is disclosed for preparing an austemperable cast iron which produces an ausferritic matrix, the cast iron having a silicon content of from about 1.6 to about 2.4 weight percent, preferably 1.8 weight percent, and a carbon content of from about 1.6 to about 2.2 weight percent, preferably 2.0 weight percent, such that the carbon equivalent of the cast iron is from about 2.1 to about 3.0 weight percent. Most desirable compositions produced by the present method have carbon equivalents of about 2.6 weight percent. The term "carbon equivalent" is defined as the amount of carbon in weight percent plus $\frac{1}{3}$ of the amount of silicon present in weight percent. It is desirable for the manganese content of the composition produced by this invention to be kept between 0.2 and 0.35 weight percent. However, especially in smaller castings, a greater than 0.35 weight percent manganese content is tolerable.

Therefore, the manganese content is preferably kept between 0.1 and 0.8 weight percent. The silicon is typically added in the form of ferrosilicon containing about 75 to 80 weight percent silicon, although any other means of adding silicon is contemplated. The austemperable cast iron made by this invention may be generally described as having an ausferritic matrix, with the cast iron including the typical silicon content of a nodular iron, and the typical carbon content of a malleable iron, thereby forming a hybrid iron capable of being austempered.

In order to austemper the hybrid iron made by the present method, and depending on the size of the casting, it may also be necessary to add hardenability agents, such as molybdenum, copper, or nickel, either singly or in any combination thereof, for aiding austemperability. For example, a small casting up to a half inch thickness usually does not require alloying with the above mentioned hardenability agent(s) because the part is so small that sufficient quenching severity can be experienced throughout the bulk of the casting without the aids.

On the other hand, heavier castings may require the addition of such hardenability agents to allow through quenching of the thicker casting components to achieve through hardening of the desired severity. Ranges of the hardenability agents change with the size of the casting, but the range of molybdenum 0 to 0.5% by wt. copper 0 to 0.8% by wt., and nickel 0 to 2.0% by wt. has been found to be particularly effective for larger castings than those having thicknesses greater than one-half inch. The amount of these elements are greatly dependent upon the quenching equipment and the quenching mediums being used. If, for instance, when molten salts are used in a large quenching container (with or without water), the hardenability agents preferably used would be copper, molybdenum and nickel, in respective amounts. This is due to the fact that molten salts quench larger castings more quickly than oil. If oil is used as the quenching medium, the same hardenability agents would be used, but in greater amounts because quenching in oil taken longer than quenching in molten salts.

A novel method for producing the cast iron composition includes (a) melting the cast iron composition to form a homogeneous melt; (b) pouring the melt into a mold to form a casting; (c) altering the temperature of the casting to about 1650°-1900° F. and maintaining the temperature of the casting at about 1650°-1900° F. until substantially all of the eutectic carbide particles convert to temper graphite nodules to form a temper graphite-containing casting; (d) cooling the temper graphite-containing casting to about 1500°-1750° F. and maintaining the temperature of the graphite-containing casting at about 1500°-1750° F. until a fully austenitic matrix is achieved, and the matrix is saturated with carbon; (e) quenching the austenitic matrix casting to a temperature of about 460° to about 750° F. and maintaining the temperature of about 460° to about 750° F. until the entire casting is substantially transformed to an ausferritic matrix; and then (f) cooling the casting to room temperature before a significant amount of bainite is formed. Before the part is altered in temperature to about 1650°-1900° F., the molded part must be shaken out to clean off any residual sand from the molding process.

The composition made by this invention is melted to a temperature of about 2850° F. and poured into a mold when it reaches a temperature of about 2550° F. After pouring the melt into a mold to form a casting (step b), the casting may either be (1) cooled to a temperature to solidify and cool the casting below about 1650° F. which enables shake out of the casting to clean residual sand from the casting procedure prior to heating the casting back up to about 1650°-1900° F., or (2) the casting may be cooled to room temperature, typically 65° to 75° F., shaken out to clean residual sand from the castings, and then reheated to about 1650°-1900° F.

Solidification of the melt typically occurs at about 2000°-2100° F. The first method of cooling mentioned above which cools the casting to below 1650° F. prior to reheating may, in some instances, save significant energy and cost. The handling of the casting is, however, more difficult than in the second method as described in more detail with respect to Example 2 hereinbelow. With respect to this method, the castings require shaking out before reheating up to 1650° to 1900° F. This shaking out may be done at about 1500° F. without substantial damage to the castings. The parts need to be shaken out to remove mold sand and need to be cleaned before heat treatment so that the sand will not contaminate the quenching medium.

FIG. 1 provides a schematic diagram of the first heat treatment method when the casting is only sufficiently cooled to allow shake out before reheating to proceed with heat treatment. Initially, the charge material is heated to about 2850° F. to melt it and is mixed for about one-half hour at that temperature. Then the melt is teamed with the alloying elements, the silicon, manganese, the hardenability agents (although the silicon and manganese can be added directly into the initial charge material), and cooled to a pouring temperature of about 2550° F. A casting is then poured into a mold and allowed to solidify at about 2100° F., depending upon the varying concentration of additives incorporated. The casting is then cooled to about 1500° F. at which temperature the castings are shaken out and cleaned.

Thereafter, the castings are heated up to about 1650°-1900° F., preferably about 1800° F. to malleabilize the castings, when the carbide breaks down into graphite and elemental iron, Fe. The malleabilized casting is cooled to about 1550° F. to 1700° F., preferably about 1600° F. for austenitization, followed by downquenching at a rapid rate to an austempering temperature range of from about 460° to about 750° F., depending on the desired metallurgical properties, such as yield and tensile strengths, elongation, impact strength and hardness. For example, at the higher end of the 460° to 750° F. range, the yield strength is expected to be about 120 ksi, tensile strength will be about 160 ksi, elongation may be about 14%, impact strength will be 100 ft-lb (at room temperature) and hardness will be about 280 BHN. At the lower end, towards 460° F., the yield strength is expected to be about 230 ksi, the tensile strength should be about 260 ksi, while the elongation may be about 2%, the impact strength will be about 50 ft-lb (at room temperature for an unnotched Charpy impact bar) and the hardness is expected to be about 520 BHN.

Figure 2:
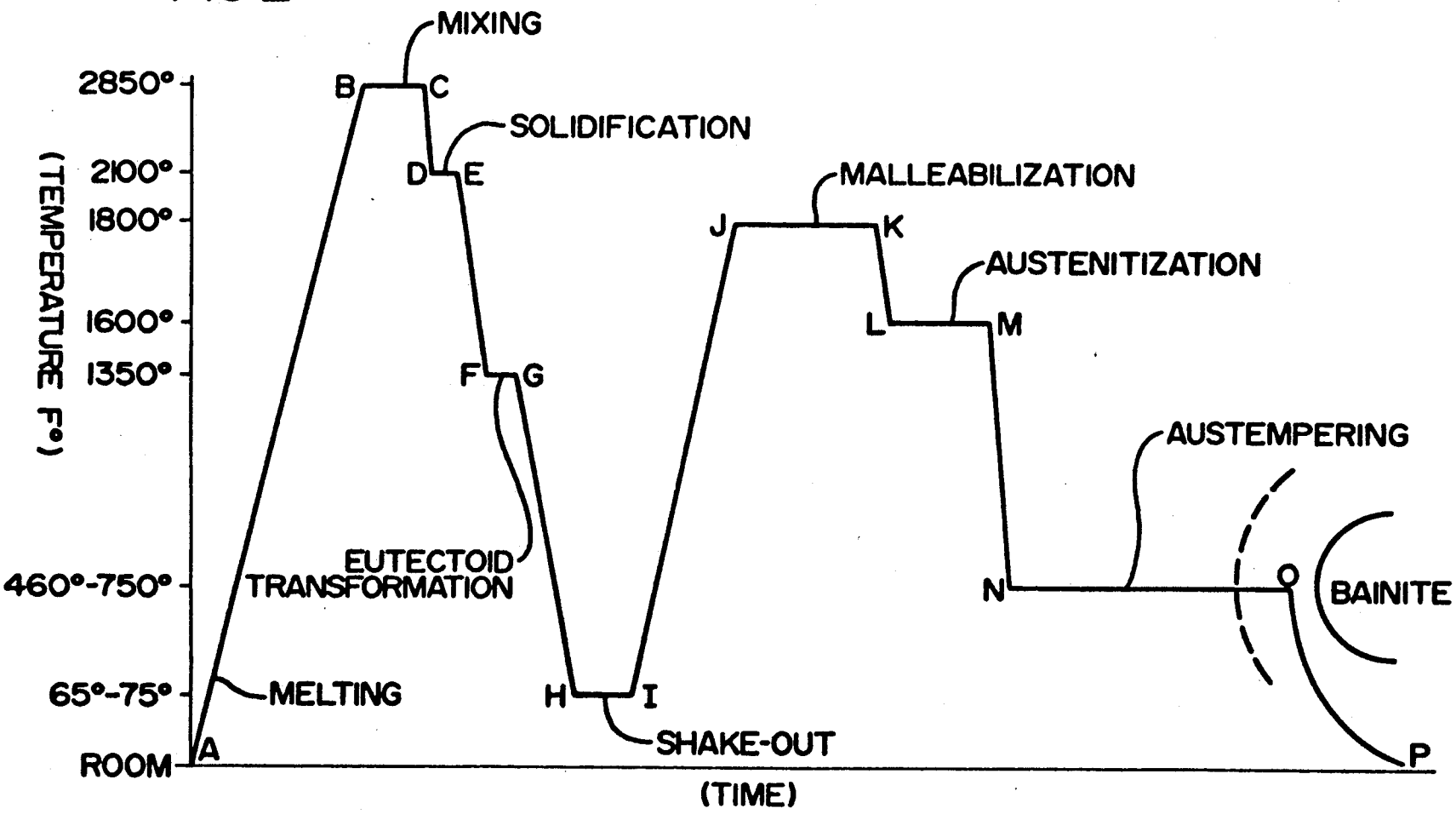
FIG. 2 shows a schematic diagram of a second process for heat-treating the cast iron composition of the invention.

FIG. 2 provides a schematic diagram of the second heat treatment method when the casting is cooled to ambient temperature and solidified prior to heating to about 1650°-1900° F. The castings are shaken out at room temperature to clean off residual mold sand before heating to this temperature. The y axis represents increasing temperatures and the x axis indicates increasing time. The heat treatment begins at point I when the casting is at ambient temperature and solidified. During the treatment period represented by line segment, I-J, the iron casting is heated to about 1650°-1900° F., preferably about 1800° F. The heating to 1650°-1900° F. may be accomplished at a rate of between 500°-2000° F. per hour. The casting is maintained at about 1650°-1900° F. as shown by line segment J-K, which is generally over about a 2 to 8 hour period. During this stage, it is thought that the casting malleablizes, such that the eutectic carbide particles convert to temper graphite nodules which are substantially spherically-shaped.

The casting is then cooled to about 1500°-1750° F., preferably about 1600° F., as shown by line segment K-L. The cooling may be accomplished at a rate of about 50° to about 500° F. per hour. The casting is then maintained (line segment L-M) at about 1500°-1750° F., typically for about to about 4 hours and, more typically, for about 2 hours to effect austenitization. The casting is then downquenched, indicated by the line between point M and point N of FIG. 2, to a temperature of about 460° to 750° F. by submerging the casting in a quenching medium which is maintained (line segment N-O) at the desired transformation temperature which also is the austempering temperature.

Suitable quenching mediums include hot oil and molten salts. The molten salt medium may be a solution, for example, of 0-50 volume % potassium nitrate and 50-100 volume % sodium nitrite. A highly suitable solution consists of a 50:50 volume to volume ratio of potassium nitrate and sodium nitrite. Fluidized beds of metal shot may also be used as the quenching medium. Typically, the rate of quenching is about 100° to 1000° F. per minute. The casting is maintained at a temperature between about 460° to about 750° F. for usually 0.25 to 8 hours. Maintaining the temperature of the casting between 460° and 750° F. is shown by the line between points N and O. The casting is then cooled to room temperature, e.g., by allowing the casting to air-cool, before bainite is formed. This is indicated by the segment between points O and P.

With the cast iron compositions made by this invention, which include the high silicon content, the bainite formation nose as shown in FIG. 2 is delayed to the right of the diagram as opposed to typical low silicon content cast iron mixtures which form bainite more readily. The dotted line indicated by the letter P illustrates the usual position for the bainite nose in conventional malleable cast iron compositions. As the formation of bainite is undesirable, the ability of the present composition to delay bainite formation is advantageous. The additional time window afforded by the present composition helps the heat treatment process to be more forgiving without the worry of undesirable bainite formation in a short period of time. More leeway is therefore available in the timing of the treatment step shown by the line segment N-P.

Due to the specified composition of the cast iron made in accordance with the present invention, which results in a carbon equivalent of about 2.1-3.0, a hypoeutectic alloy is formed. The heat treatment results in a cast iron having an ausferritic matrix with relatively small volumes of graphite. An ausferritic matrix is defined as a combination of acicular ferrite and stable austenite supersaturated with carbon. Because of the composition of the cast iron made by this invention, control of the matrix structure is easier than with either conventional malleable or ductile irons. The resulting hypoeutectic iron has lower graphite volumes than ductile iron. The lower amount of graphite in the cast irons of this invention yield products which are stronger than typical ductile irons.

In hyper-eutectic irons, such as in conventional ductile iron, the silicon component segregates close to the graphite nodules and the manganese component segregates into the cell boundaries. In hypoeutectic irons, such as in the present austemperable iron, the segregation is reversed. Silicon segregates into the cell boundaries, while manganese segregates close to the nodule exterior. This phenomenon beneficially influences the carbon distribution and kinetics during heat treatment. Although silicon generally reduces carbon solubility, manganese increases carbon solubility in austenite.

Figure 3:
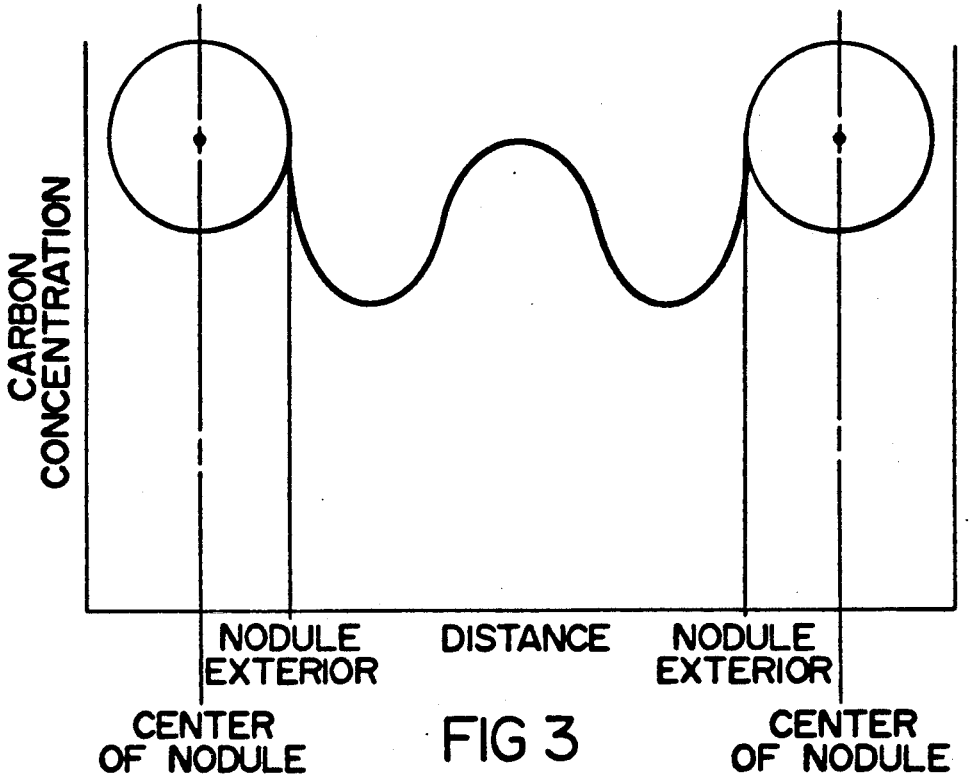
FIG. 3 shows a schematic diagram of a concentration in a typical ductile iron.
Figure 4:
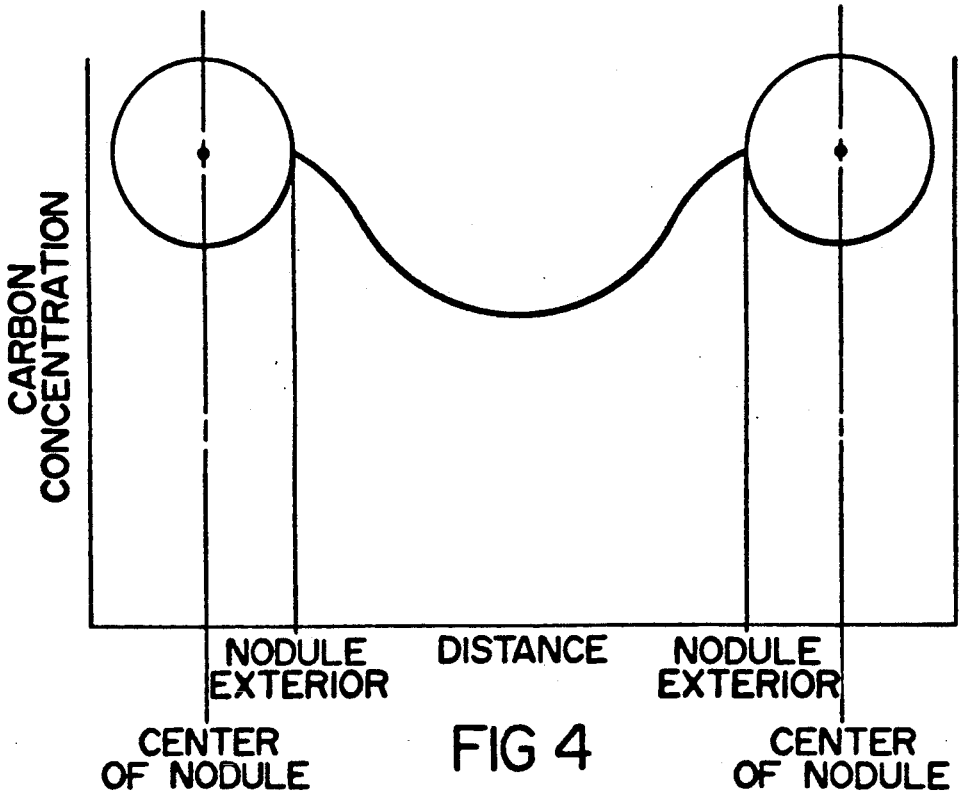
FIG. 4 shows a schematic diagram of the carbon distribution within the cast iron of the present invention.

A schematic drawing of the carbon distribution in typical ductile iron is shown in FIG. 3, while carbon concentration distribution experienced by austemperable cast iron made by the present invention is represented in FIG. 4. As shown, the carbon concentration in our austemperable iron is higher near the nodule exterior than in a typical ductile iron. Not only does our austemperable iron have a lower graphite volume, but smaller graphite nodule size is also experienced. The smaller nodule size results in reduced solute segregation, thereby giving more uniform solute distribution and more uniform mechanical properties. This is advantageous in a heat treated cast iron part because uniformity of mechanical properties yields a more uniform strength throughout the part. As can be seen by one of ordinary skill in the art, the increased uniformity in strength and mechanical properties yields a cast iron part having improved strength characteristics without weaknesses.

Thus, there is provided in accordance with the present invention, a method for making a cast iron composition which has a uniform structure and physical properties and improved mechanical properties which may be heat-treated by a more flexible process than before, also providing better control of the resulting matrix structure. The cast irons made by this invention are especially useful for moving machinery components which require high impact strength, wear resistance, tensile strength, and enhanced ductility.

While our invention has been described in terms of a specific embodiment, it will be appreciated that other embodiments could readily be adapted by one skilled in the art. Accordingly, the scope of our invention is to be limited only by the following claims.

What is claimed is:

1. A method of preparing an austempered cast iron, comprising:
(a) melting a cast iron mixture containing
(i) from about 1.6 to about 2.4 weight percent silicon, and
(ii) from about 1.6 to about 2.2 weight percent carbon to form a homogeneous melt, said melt having a carbon equivalent from about 2.1 to about 3.0 weight percent;
(b) pouring the melt into a mold to form a casting having eutectic carbide particles;
(c) shaking out the casting to remove any residual mold sand;
(d) altering the temperature of the casting to about 1650°-1900° F. and maintaining the temperature of the casting at about 1650°-1900° F. for about 2 to about 8 hours to malleabilize until substantially all of the eutectic carbide particles convert to temper graphite nodules to form a temper graphite-containing casting;
(e) cooling the temper graphite-containing casting to about 1500°-1750° F. and maintaining the temperature of the temper graphite-containing casting at about 1500°-1750° F. until a fully austenitic matrix is achieved, and the matrix is saturated with carbon;
(f) quenching the austenitic matrix casting to a temperature of about 460° to about 750° F. and maintaining that temperature until the casting is substantially transformed to an ausferritic matrix; and
(g) cooling the ausferritic matrix casting to room temperature before a significant amount of bainite is formed.

2. A method of preparing an austempered cast iron, comprising:
(a) melting a cast iron mixture containing
(i) from about 1.6 to about 2.4 weight percent silicon, and
(ii) from about 1.6 to about 2.2 weight percent carbon to form a homogeneous melt, said melt having a carbon equivalent from about 2.1 to about 3.0 weight percent;
(b) pouring the melt into a mold to form a casting having eutectic carbide particles;
(c) shaking out the casting to remove any residual mold sand;
(d) altering the temperature of the casting to about 1650°-1900° F. and maintaining the temperature of the casting at about 1650°-1900° F. until substantially all of the eutectic carbide particles convert to temper graphite nodules to form a temper graphite-containing casting;
(e) cooling the temper graphite-containing casting to about 1500°-1750° F. for about 1 to about 4 hours and maintaining the temperature of the temper graphite-containing casting at about 1500°-1750° F. until a fully austenitic matrix is achieved, and the matrix is saturated with carbon;
(f) quenching the austenitic matrix casting to a temperature of about 460° to about 750° F. and maintaining that temperature until the casting is substantially transformed to an ausferritic matrix; and
(g) cooling the ausferritic matrix casting to room temperature before a significant amount of bainite is formed.

3. A method of preparing an austempered cast iron, comprising:
(a) melting a cast iron mixture containing
(i) about 1.8 weight percent silicon,
(ii) about 2.0 weight percent carbon, and
(iii) 0.2-0.35 weight percent manganese to form a homogeneous melt;
(b) pouring the melt into a mold to form a casting;
(c) cooling the casting to a temperature below solidification;
(d) shaking out the solidified castings to remove the mold and any residual mold sand;
(e) heating the casting to about 1650°-1900° F. at a rate of about 500° to 2000° F. per hour and maintaining the temperature of the casting at about 1650°-1900° F. for about 2 to 8 hours until substantially all of the eutectic carbide particles convert to temper graphite nodules to form a temper graphite-containing casting;
(f) cooling the temper graphite-containing casting to about 1500°-1750° F. at a rate of about 50° to 500° F. per hour and maintaining the temperature of the temper graphite-containing casting at about 1500°-1750° F. for about 1 to about 4 hours until a fully austenitic matrix is achieved, and the matrix is saturated with carbon;
(g) quenching the austenitic matrix casting to a temperature between about 460° to about 750° F. at a rate of about 100° to about 1000° F. per minute by immersing the casting in a medium for about 0.25 to about 8 hours until the casting is substantially transformed to an ausferritic matrix; and
(h) then cooling the casting to room temperature before a significant amount of bainite is formed.

4. The method of claim 3, wherein the cooling of the casting to a temperature below solidification is accomplished by cooling the casting to room temperature.

5. The method of claim 3, wherein the cooling of the casting to a temperature below solidification is accomplished by cooling the casting to about 1500° F.

* * * * *